United States Patent [19]

Prentice et al.

[11] 4,096,377

[45] Jun. 20, 1978

[54] COUNTER MECHANISM

[75] Inventors: James A. Prentice, Orange; John George Mitchell, Fountain Valley, both of Calif.

[73] Assignee: California Injection Molding Co., Inc., Costa Mesa, Calif.

[21] Appl. No.: 707,837

[22] Filed: Jul. 22, 1976

[51] Int. Cl.[2] ..... G06C 15/42

[52] U.S. Cl. ..... 235/144 HC; 235/139 R; 235/144 SM; 235/144 SS

[58] Field of Search ..... 235/144 HC, 144 SS, 235/144 SM, 139

[56] References Cited

U.S. PATENT DOCUMENTS

| | | | |
|---|---|---|---|
| 2,980,329 | 4/1961 | Hoffmann | 235/139 |
| 3,337,129 | 8/1967 | Johnson | 235/133 |
| 3,441,210 | 4/1969 | Moore et al. | 235/144 SM |
| 3,494,549 | 2/1970 | Spath | 235/144 HC |
| 3,529,769 | 9/1970 | Howard | 235/144 HC |
| 3,546,439 | 12/1970 | Sampson et al. | 235/144 |
| 3,556,398 | 1/1971 | Walsh | 235/144 HC |
| 3,588,476 | 6/1971 | Lapointe | 235/117 |
| 3,777,973 | 12/1973 | Kundisch et al. | 235/144 HC |
| 3,845,899 | 11/1974 | Irie et al. | 235/144 HC |

*Primary Examiner*—Stephen J. Tomsky
*Attorney, Agent, or Firm*—Gausewitz, Carr & Rothenberg

[57] ABSTRACT

A resettable mechanical counter having a plurality of number wheels and transfer pinions is mounted in a molded plastic housing in which are integrally formed fixed bosses that index the transfer pinions when the number wheels are reset. The transfer pinions are axially located by means of slots formed in the housing and the number wheels are axially located relative to the reset lever mechanism which itself is axially located relative to the housing to thus position the transfer pinions relative to the number wheels.

11 Claims, 7 Drawing Figures

COUNTER MECHANISM

BACKGROUND OF THE INVENTION

The present invention relates to counter mechanisms and more particularly concerns an improved and simplified counter mechanism that is more readily and inexpensively fabricated.

As counter mechanisms find wider and ever-increasing use, it is of greater importance to simpify the manufacture and to improve reliability and ease of assembly. Common types of resettable counter mechanisms such as those shown in the patent to Howard, U.S. Pat. No. 3,529,769, the patent to Lapointe, U.S. Pat. No. 3,588,476 and the patent to Zielke, U.S. Pat. No. 3,597,595, which are typical of counters of this general type, employ a plurality of number wheels having transfer pinions that transmit an incremental motion to one wheel in response to a complete revolution of another wheel. A resetting mechanism, in the form of a number of bellcrank levers, cooperates with heart-shaped cams on the number wheels to reset all of these simultaneously. The resetting operation also moves the transfer pinions out of engagement with the number wheels and at the same time indexes or resets the transfer pinions. The pinions are indexed by forcing them against resilient spring fingers that are attached to the counter housing.

Relative axial positioning of the number wheels and transfer pinions may be achieved either by locating all of these with regard to the reset mechanism, as in Howard, by mounting partitions on the shafts, as in Lapointe, or by dividing the housing into independent chambers, as in Zielke.

A particular disadvantage of prior art constructions is the complexity and cost of manufacture and assembly. The requirement of fabricating and assembling separate plural element spring fingers for indexing transfer pinions adds both to cost and time of assembly. The need for great rigidity and dimensional stability of the housing of the device dictates the use in prior arrangements of a rigid metal housing that is often more costly and difficult to fabricate. The provision of separate chambers for each of the transfer pinions and number wheels provides for an unnecessarily complex housing and adds to the difficulty of assembly.

Accordingly it is an object of the present invention to provide a resettable counter mechanism that is inexpensive to manufacture, reliable in operation and eliminates or minimizes above-mentioned problems.

SUMMARY OF THE INVENTION

In carrying out principles of the present invention in accordance with a preferred embodiment thereof, a counter has number wheels rotatably mounted in its housing with a slidably mounted shaft carrying transfer pinions. A reset lever resets the number wheels and shifts the transfer pinions into engagement with bosses that are integral with the housing, thus indexing the transfer pinions and strengthening the housing. Axial positioning is provided by locating transfer pinions and the resetting mechanism with respect to the housing and locating the number wheels with respect to the transfer mechanism. The counter is particularly designed for manufacture by injection molding of plastic material in which resilience inherent in the material allows the use of fixed bosses formed in the housing in place of resilient springs for indexing of transfer pinions. Yet the same bosses enhance rigidity of the plastic housing.

DETAILED DESCRIPTION

Figure 1:
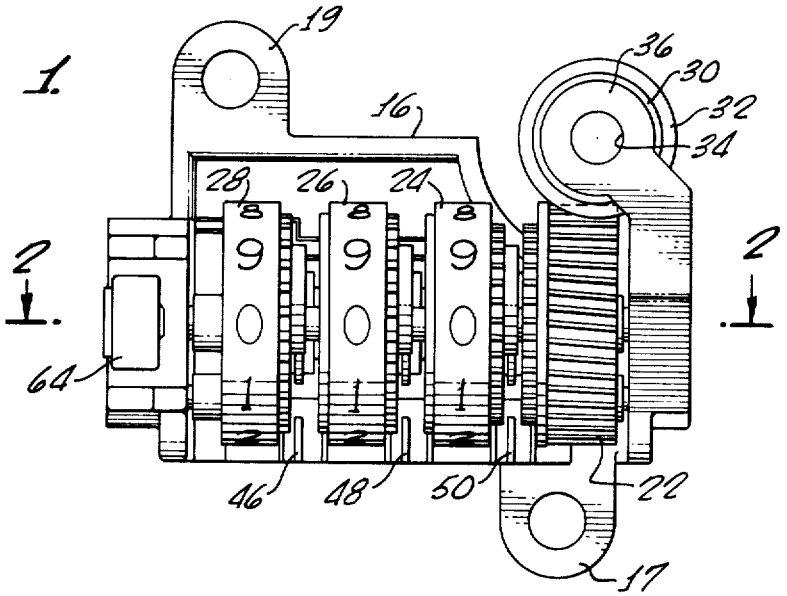
FIG. 1 is a top view of a counter mechanism embodying principles of the present invention.
Figure 1:
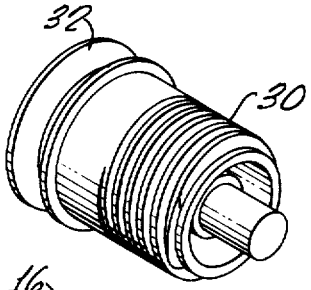
Figure 4:
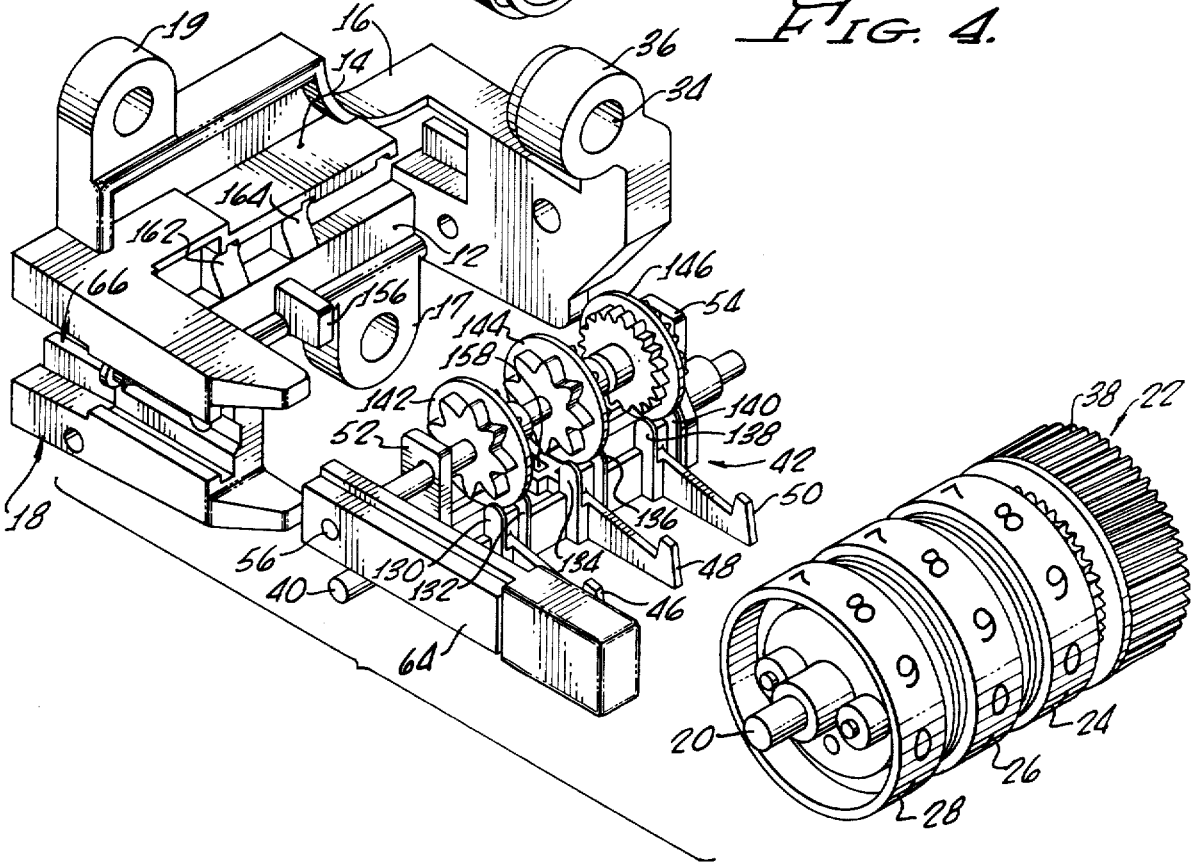
FIG. 4 is an exploded perspective view of major components of the counter of FIGS. 1, 2 and 3.

As illustrated in the drawings, a counter mechanism embodying principles of the present invention comprises a substantially rigid housing formed of an integral plastic body having mutually spaced and parallel base arms 12, 14 and first and second end standards 16, 18 connected to the arms, upstanding therefrom and thus fixedly connecting the arms to each other. Apertured mounting lugs 17, 19 project outwardly from base arms 12, 14. A first shaft 20 is mounted in the standards 16, 18 and rotatably supports a drive gear 22, a units number wheel 24, a tens number wheel 26 and a hundreds number wheel 28. A worm 30 (FIGS. 1, 4) having a drive pulley 32 fixed thereto is journalled in an aperture 34 extending through a lug 36 that projects outwardly from an upper end of standard 16. Worm 30 meshes with teeth 38 of drive gear 22. Thus a driven belt (not shown) may be entrained in the groove of pulley 32 to drive worm 30 and thus drive the gear 22.

A second shaft 40 is mounted in the housing and supports a reset lever mechanism 42 (FIG. 4) in the form of a plurality of spaced bellcrank levers. Reset mechanism 42 comprises an elongated body 44 having a plurality of axially spaced reset hammers 46, 48, 50. Integral with the reset body 44 are a pair of axially spaced projecting drive legs 52, 54 having apertures therein through which extends a pinion shaft 56 having one end slidably mounted in housing standard 16. Rotatably mounted upon the shaft 56 are a primary or drive pinion 58 and a pair of secondary or transfer pinions 60, 62.

Figure 2:
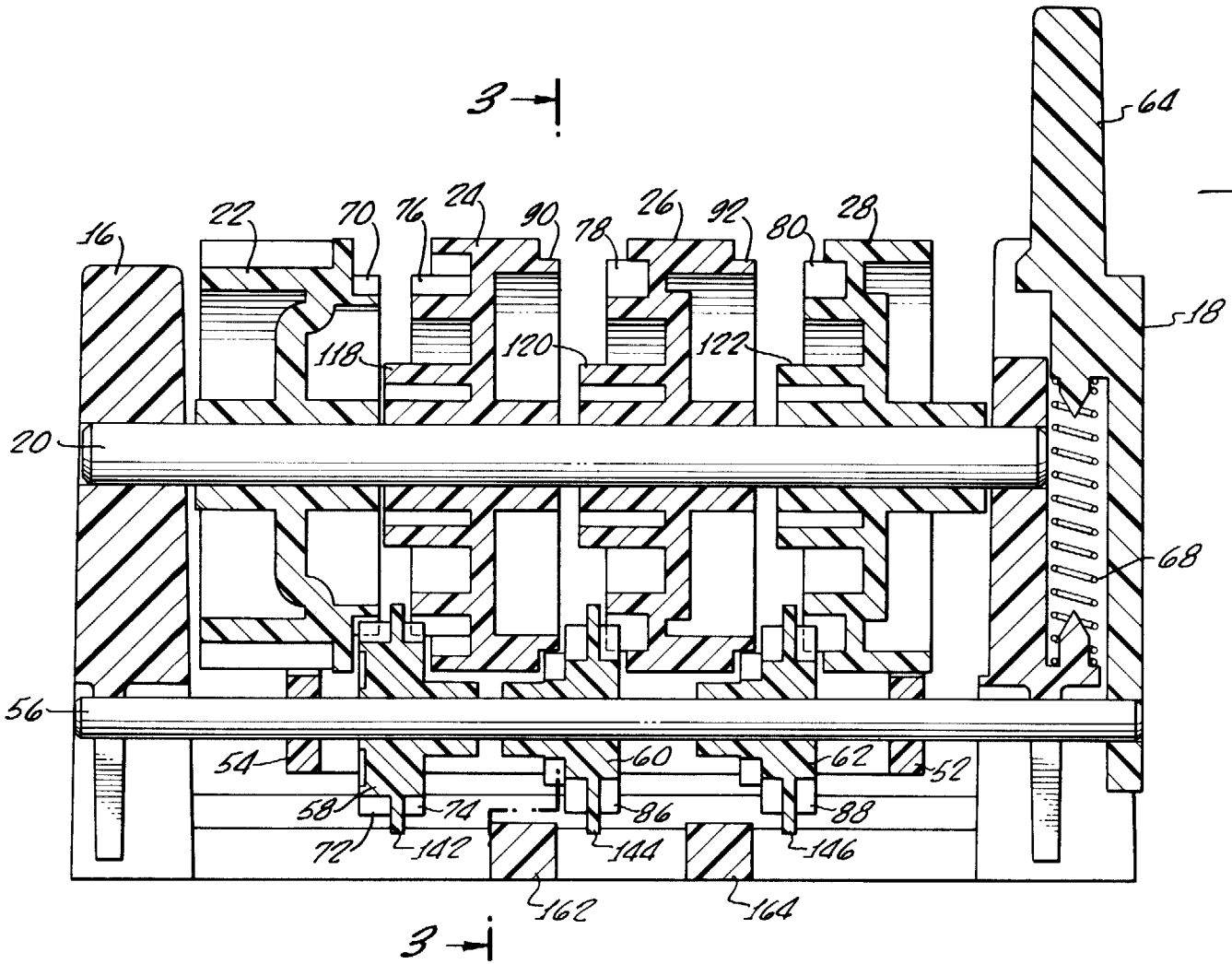
FIG. 2 is an enlarged section taken on lines 2—2 of FIG. 1.

Connected to the other end of pinion shaft 56 is a reset operator slide 64 that is slidably mounted in a guideway 66 (FIG. 4) formed in housing standard 18. A compression spring 68 (FIG. 2) is captured within the guide 66 and slide 64. The spring is interposed between an end of the guide and the reset operator slide, in order to return the slide to its normal position after it has been depressed.

Drive gear 22 is formed with a plurality of teeth 70 (FIG. 2) that mesh with drive teeth 72 on one side of drive pinion 58. Drive pinion 58 includes a second set of teeth 74, on the other side thereof, that mesh with and drive a set of drive teeth 76 on the units number wheel 24.

Figure 6:
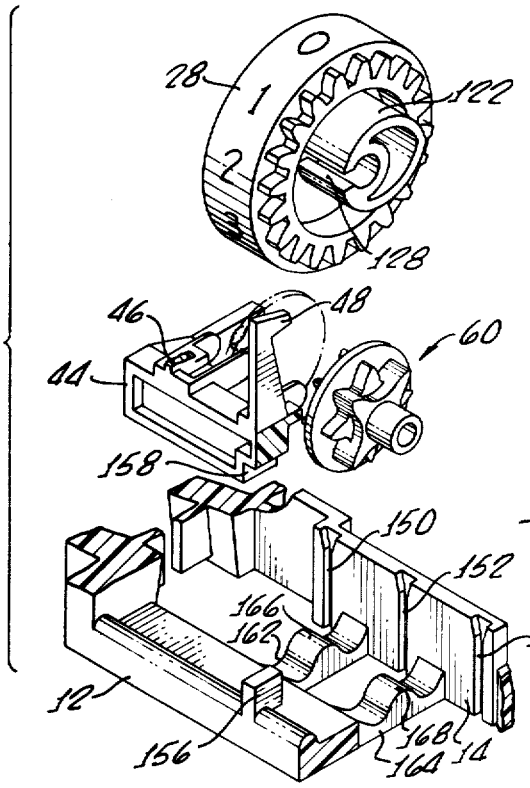
FIG. 6 is a perspective view of one of the number wheels showing the side having wheel transfer lugs thereon.

Each of the number wheels 26 and 28 has a set of drive teeth such as teeth 78, 80, similar to the drive teeth 76 of the units wheel 24. On the other side thereof each number wheel has a pair of wheel transfer lugs, such as lugs 82, 84 (FIG. 6) that cooperate with teeth on the transfer pinions. Hundreds wheel 28, being the last number wheel, does not drive any transfer pinion and accordingly need not have any wheel transfer lugs.

Figure 3:
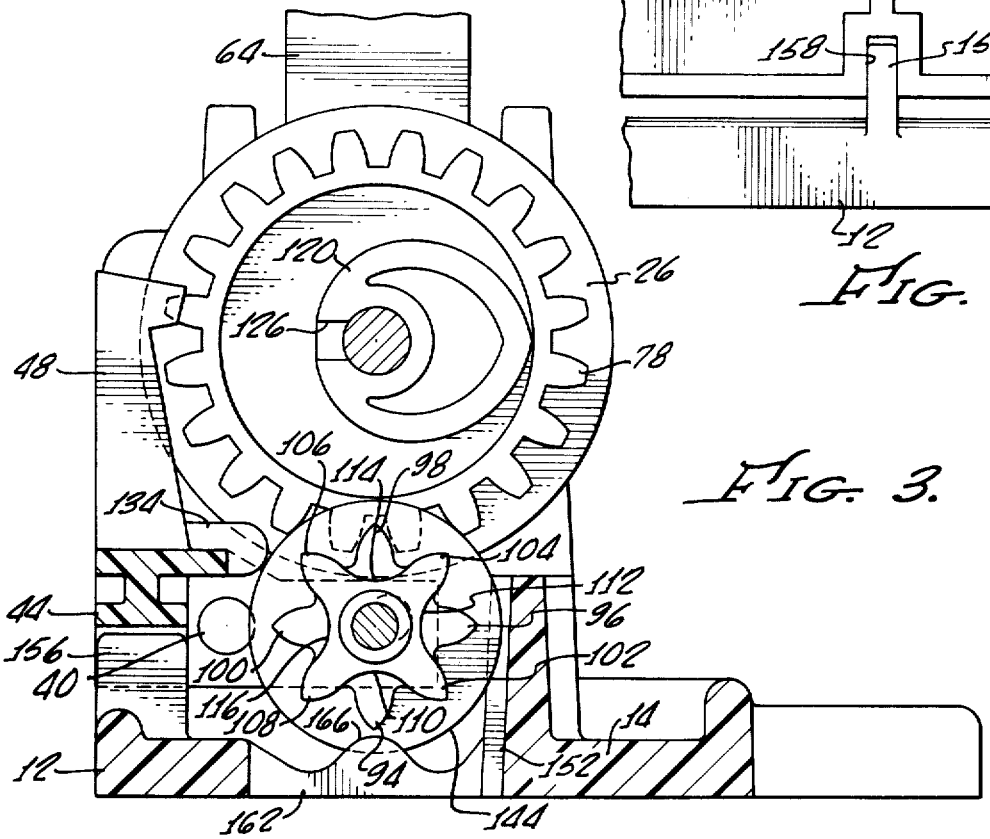
FIG. 3 is a section taken on lines 3—3 of FIG. 2.

Each of the secondary transfer pinions 60, 62, is formed with a plurality of teeth 86, 88 on one side thereof which engage drive teeth 78, 80 on the tens and hundreds wheels 26, 28. The other side of each of the transfer pinions 60, 62 is formed with two inter-digitated sets of teeth of different axial extent. Thus a first set of teeth of one side of each of the transfer pinions 60, 62 comprises mutilated teeth 94, 96, 98, 100 (FIG. 3) which are of relatively short axial extent and the second inter-digitated group comprises teeth 102, 104, 106 and 108 of relatively great axial extent. The two groups of teeth cooperate to define tapered indexing recesses 110, 112, 114, 116 which are employed for indexing of the transfer pinions as will be described below.

The reset mechanism comprises a heart-shaped cam 118, 120, 122 on each of the number wheels having a slot, such as slot 126, 128, that cooperates with the head of the reset hammers 46, 48, 50 to locate the zero position of the number wheels.

The reset lever mechanism body 14 is formed with a plurality of radially projecting and mutually spaced locator lugs 130, 132, 134, 136, 138 and 140 (FIG. 4), each of which bears upon an outer peripheral edge of a respective one of the number wheels so as to axially locate these relative to the reset mechanism and relative to each other. Locator lugs 130 through 140 are short enough to avoid possible interference with the teeth of the transfer pinions and are mutually spaced sufficiently so that they do not contact the transfer pinions, but contact only the number wheels. This avoids the potential problem of interference between the number wheel locator lugs and the transfer pinions during the shiftable motion of resetting of the number wheels.

Figure 5:
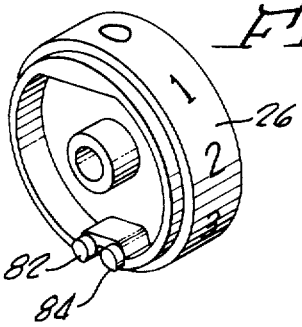
FIG. 5 is a fragmented exploded perspective view showing further details of the number wheels and transfer pinions.

For locating of the transfer pinions, each is formed with a radially outwardly extending peripheral flange 142, 144 and 146, and base arm 14 of the housing is provided with an upstanding wall (FIG. 5) having slots 150, 152, 154 that slidably receive the respective flanges 142, 144, 146 of the transfer pinions, thus precisely positioning the pinions axially with respect to the housing. Slots 150, 152 and 154 are inclined (FIG. 3) so that they more closely follow the arcuate path of motion of the transfer pinions during reset operation.

Figure 7:
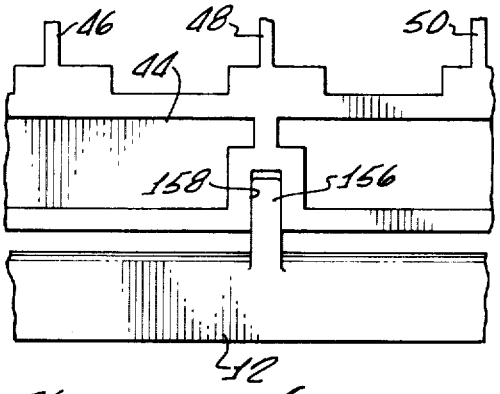
FIG. 7 is a fragmentary view showing the reset mechanism axially positioning.

The bellcrank levers of the reset lever mechanism are fixedly positioned with respect to the housing, axially of the pivot axis thereof, by lug and recess means on the reset lever mechanism body and the housing. A lug 156 (FIGS. 5, 7) is fixed to and projects upwardly from housing base arm 12 for a snug but sliding reception in a recess 158 formed in a lower portion of the body 44 of reset lever mechanism 42. Thus the reset lever mechanism is fixedly positioned axially relative to the housing. Since the transfer pinions also are fixedly positioned axially relative to the housing and the number wheels are fixedly positioned axially relative to the reset mechanism, the number wheels are fixedly positioned axially relative to the transfer wheels. Further, both the number wheels and the transfer pinions are not only positioned axially relative to one another but all are positioned axially with respect to the housing by means of the lug 156 and slot 158, and also the transfer wheel locating slots 150, 152 and 154.

Extending between base arms 12 and 14 and bridging the space therebetween are a pair of indexing bosses 162, 164 (FIG. 5) which provide a strong reinforcement for the base arms 12, 14 to thereby add greatly to rigidity of the housing. The bosses are formed with convex arcuate or tapered indexing surfaces 166, 168 that precisely mate with the arcuate or tapered indexing recesses 110 through 116 of the transfer pinions.

In operation, driving of pulley 32 drives worm 30 to turn drive gear 22 which in turn rotates primary pinion 58. Units wheel 24 is continuously driven by pinion 58 and, by means of wheel transfer lugs 82, 84, incrementally drives transfer pinion 60 through a fraction of one full rotation for each full rotation of the units wheel. Drive teeth 86 on transfer pinion 60 drive the tens number wheel 26 which in turn, for each full rotation thereof, drives the second transfer pinion 62 through an increment of its full rotation. Transfer pinion 62 in turn drives the hundreds wheel 28.

To reset the number wheels, the reset operator slide 64 is depressed against the force of return spring 68 thereby pivoting the reset hammers about shaft 40 against the reset cam surfaces of the number wheels to reset each of the wheels.

As the reset hammers pivot, shaft 56 that is carried in reset lever mechanism legs 52, 54, swings downwardly (as viewed in FIG. 3) in an arcuate path about reset lever mechanism shaft 40. This shifting of the shaft 56 moves the drive pinion and the transfer pinions from their engagement with the number wheels before the recess hammers contact the reset cams.

In addition to resetting of the number wheels to a zero position, it is necessary to index the transfer pinions 60, 62 so that the teeth are in a proper position with respect to the wheel transfer lugs 82, 84. Thus, the bosses 162, 164 with their convex arcuate surfaces firmly engage the congruent concave arcuate indexing recesses of the transfer pinions to place each of the latter in one of its four appropriate index positions. The mating arcuate surfaces of indexing bosses and recesses provide a precise indexing of the transfer pinions because the bosses, which are integrally molded with the housing, are readily configured to precisely mate with the indexing recesses of the pinions. As previously mentioned, the bosses in addition to providing precise indexing, greatly strengthen the base arms of the injection molded plastic housing and increase overall rigidity of the mechanism.

All of the number wheels and pinions are axially aligned in precise position relative to one another and relative to the housing itself by the arrangement that locates both the transfer pinions and the reset lever mechanism directly with respect to the housing and that also locates the number wheels with respect to the reset lever mechanism. Further, since the indexing bosses 162, 164 are fixed to the frame and the transfer pinions which are indexed by the bosses are also axially located with respect to the frame, more precise and reliable relative alignment of transfer pinions and indexing bosses is provided.

Although many types of plastic materials may be employed for molding of the described counter parts, Noryl material, a modified polyphenylene oxide made by General Electric is preferred because of its high dimensional stability over a wide temperature and humidity and moisture range. Because of the need for increased lubricity in the reset lever mechanism, an acetal resin such as Delrin made by Dupont, or Selcon made by Celanese Corporation is preferred at present. Preferably, all of the parts are injection molded of the named plastics or other suitable plastics except for the three shafts and the spring, which are metal.

It will be seen that the described arrangement provides a counter mechanism of rigid, durable and dimensionally stable precision construction that is readily adapted to injection molding and assembly at reduced cost. A rigid plastic housing is provided which cooperates with unique locating slots and mechanisms to assure precision positioning of the several elements.

The foregoing detailed description is to be clearly understood as given by way of illustration and example only, the spirit and scope of this invention being limited solely by the appended claims.

We claim:

1. In a counter having a housing, a plurality of number wheels rotatably mounted in the housing, a plurality of transfer pinions interposed between and engaged with the number wheels and shiftable out of engagement therewith during resetting of the wheels, and a reset mechanism for resetting the number wheels and shifting the transfer wheels out of engagement with the number wheels, the improvement comprising a pair of mutually spaced side arms forming part of said housing, a plurality of indexing bosses formed integrally with and extending between both said side arms of said housing, said bosses being configured and positoned to mate with and to reset respective transfer pinions as the pinions are shifted to a position out of engagement with said number wheels, said bosses strengthening and rigidifying said housing.

2. The counter of claim 1 wherein at least one of said pinions has first and second interdigitated groups of teeth, the teeth of one of said groups having an axial extent greater than the axial extent of teeth of the other of said groups to thereby define indexing recesses receiving one of said bosses when said one pinion is shifted from said number wheels.

3. The counter of claim 2 wherein said one boss and recess have mating tapered configurations to guide mating engagement thereof and index said one pinion.

4. In a counter having a housing, a plurality of number wheels rotatably mounted in the housing, a plurality of transfer pinions interposed between and engaged with the number wheels and shiftable out of engagement therewith during resetting of the wheels, and a reset mechanism for resetting the number wheels and shifting the transfer wheels out of engagement with the number wheels, the improvement comprising a plurality of fixed indexing bosses formed integrally with said housing, said bosses being configured and positioned to mate with and to reset respective transfer pinions as the pinions are shifted to a position out of engagement with said number wheels, each said pinion including a radially outwardly projecting circumferential flange and said housing having a plurality of grooves formed therein for slidably receiving said flanges or respective pinions and axially positioning said pinions during motion thereof relative to said number wheels.

5. The counter of claim 4 wherein said reset mechanism includes a pivoted reset lever having means for axially locating said number wheels relative to one another and including means for axially locating said reset mechanism relative to said housing.

6. The counter of claim 5 wherein said last mentioned means comprises interengaging lug and recess means on said reset mechanism and housing.

7. A counter comprising a housing, a plurality of number wheels rotatably mounted in said housing, a shaft mounted in said housing for sliding motion radially of said number wheels and spaced therefrom, a plurality of transfer pinion means rotatably mounted on said shaft and engaged with said number wheels for transmitting rotation of one of said wheels to others of said wheels, reset lever means pivoted to said housing for resetting said number wheels and shifting said shaft and transfer pinions from engagement with said number wheels, a plurality of bosses integral with said housing and positioned to index said transfer pinions upon shifting of said pinions from said number wheels, said housing being formed of an integral plastic body having a pair of mutually spaced base arms and first and second end standards connecting said arms to each other at opposite ends of said arms, said wheels and pinions being mounted between said standards, said bosses being integral with and bridging the space between said base arms to firmly connect said arms to each other.

8. The counter of claim 7 wherein one of said arms includes an integral wall upstanding therefrom, said wall having a plurality of spaced slots formed therein and extending in the direction of shifting of said pinions, said pinions each including a peripheral portion received in a respective one of said slots to axially locate the pinions relative to said housing.

9. The counter of claim 8 wherein said pinions are shiftable in an arcuate path and wherein said slots are inclined to more closely follow said path.

10. The counter of claim 9 wherein said reset lever means includes means for axially locating said number wheels relative to said reset lever means, and means for axially locating said reset lever means relative to said housing.

11. The counter of claim 10 wherein said last mentioned means comprises a locating lug integral with and upstanding from the other of said base arms, and a recess formed in said reset lever means snugly receiving said locating lug.

* * * * *

UNITED STATES PATENT AND TRADEMARK OFFICE

CERTIFICATE OF CORRECTION

PATENT NO. : 4,096,377

DATED : June 20, 1978

INVENTOR(S) : James A. Prentice and George Mitchell

It is certified that error appears in the above-identified patent and that said Letters Patent are hereby corrected as shown below:

Column 6, line 1, change "or" to --of--

Signed and Sealed this

*Fifth* Day of *December 1978*

[SEAL]

*Attest:*

RUTH C. MASON
*Attesting Officer*

DONALD W. BANNER
*Commissioner of Patents and Trademarks*